US006685607B1

(12) United States Patent
Olson

(10) Patent No.: US 6,685,607 B1
(45) Date of Patent: Feb. 3, 2004

(54) EXERCISE DEVICE WITH RESISTANCE MECHANISM HAVING A PIVOTING ARM AND A RESISTANCE MEMBER

(75) Inventor: Michael L. Olson, Logan, UT (US)

(73) Assignee: Icon IP, Inc., Logan, UT (US)

( * ) Notice: Subject to any disclaimer, the term of this patent is extended or adjusted under 35 U.S.C. 154(b) by 0 days.

(21) Appl. No.: 10/340,562

(22) Filed: Jan. 10, 2003

(51) Int. Cl.[7] ..... A63B 26/00

(52) U.S. Cl. ..... 482/142; 482/148; 482/907; 482/908

(58) Field of Search ..... 482/142, 148, 482/907, 908

(56) References Cited

U.S. PATENT DOCUMENTS

| | | | |
|---|---|---|---|
| 4,275,882 | A | 6/1981 | Grosser et al. |
| 4,426,077 | A | 1/1984 | Becker |
| 4,540,171 | A | 9/1985 | Clark et al. |
| 4,618,140 | A | 10/1986 | Brown |
| 4,635,926 | A | 1/1987 | Minkow |
| 4,898,381 | A | 2/1990 | Gordon |
| 4,974,838 | A | 12/1990 | Sollenberger |
| 5,031,905 | A | 7/1991 | Walsh |
| 5,316,534 | A | 5/1994 | Dalebout et al. |
| 5,344,374 | A | 9/1994 | Telle |
| 5,527,245 | A | 6/1996 | Dalebout et al. |
| 5,685,810 | A | 11/1997 | Chung |
| 5,776,040 | A | 7/1998 | Webb et al. |

OTHER PUBLICATIONS

Owner's Manual for Impex Fitness Products, *Powerhouse Home Gym WM 1400*, Revised Jun. 30, 2000.
Website page of Impex, dated Nov. 6, 2001.
Webiste pages (16 pp.) for Impex dated Dec. 11, 2001.

*Primary Examiner*—Nicholas D. Lucchesi
*Assistant Examiner*—L Amerson
(74) *Attorney, Agent, or Firm*—Workman Nydegger; David B. Deuenbach

(57) ABSTRACT

An exercise device is configured to provide adjustable resistance to the motion of a user exercising with the exercise device. The exercise device includes a frame that at least partially supports an operable assembly. Cooperating with the operable assembly is a resistance assembly that provides a resistance adjustable by the user of the exercise device. The resistance assembly includes an actuating assembly that engages with a pivoting arm. The actuating assembly includes a handle mechanism that is simple to operate and enables a user to easily select a desirable resistance level. A connecting member of the actuating assembly extends from the handle mechanism to a resistance member. Movement of the operable assembly moves the arm toward a fixed end of the resistance member. The connecting member temporarily lengthens the resistance member, while the resistance member inhibits such movement and provides resistance to the exercising user's motion.

22 Claims, 12 Drawing Sheets

EXERCISE DEVICE WITH RESISTANCE MECHANISM HAVING A PIVOTING ARM AND A RESISTANCE MEMBER

BACKGROUND OF THE INVENTION

1. The Field of the Invention

The present invention generally relates to exercise devices and more generally to methods, systems, and devices for selectively modifying a resistance level of an exercise device.

2. The Relevant Technology

In recent years, there has been a trend towards the use of exercise equipment, whether it is at a gym or at home. Although gym exercise equipment provides many benefits to an exercising user, it is typically expensive to become a member of the gym and usually time consuming and inconvenient to exercise at the gym. Many individuals are turning to home exercise equipment to obtain the health benefits associated with daily exercising.

Although home exercise equipment is more convenient to use, in many instances the devices are cumbersome and difficult to use. For instance, many multi-gym exercise devices use free weights or other heavy weights to provide resistance during an exercise regime. These weights make positioning and subsequent movement of the exercise device difficult. Typically, once a multi-gym device has been set-up in one position, it will remain there for a significant amount of time without being moved. When the device is to be moved, the owner must spend a long period to dismantle the device, move the parts to the new position within the home, and reassemble the exercise device. Additionally, use of such a multi-gym device requires the user to set aside a significant amount of space within the user's home. This reduces the livable space within the home and typically requires that an area of the home be dedicated to the performance of exercise regimes. It would be preferential to have an exercise device that is mobile and capable of being repositioned to allow the user to utilize the space within his or her home.

Typical exercise devices use weights to provide resistance to an exercising user. The selection of weights may be difficult to achieve before and during an exercise regime. Additionally, selection of a particular resistance is limited to the incremental weights provided with the exercise device. For instance, the adjustability of the exercise device to a particular weight is often limited by the minimum numerical weight value of the weights included with the exercise device. It would be beneficial to have an exercise device where very small incremental changes in the exercise resistance were possible.

In addition to the above, the adjustability of the exercise device limits the usability of the exercise device. Many exercise devices require removal of pins and repositioning of weights to vary the resistance applied to an exercising user. This may be time consuming and difficult to achieve depending the particular configuration of the exercise device. Over time, there is a high likelihood that the pins associated with the exercise device will become lost, thereby preventing a user exercising using the exercise device.

Some exercise devices attempt to overcome the limitations associated with the use of heavy weights to provide resistance to an exercising user. These exercising devices may utilize gas or fluid cylinders that provide a resistance as a user exercises upon the exercise device. A gas or fluid within an interior chamber of the cylinder may flow through a variable restriction member that may govern the resistance applied by the cylinder. For instance, when the restriction member allows a high flow rate of fluid therethrough, the resistance applied by the cylinder is low. Similarly, when the restriction member allows a low flow rate, the cylinder provides a high resistance to the exercising user.

Although beneficial in reducing the overall weight of an exercise device, and thereby enabling repositioning of an exercise device in a simple and efficient manner, the effectiveness and long-term usage of certain gas cylinders may be limited. Over time, the gas or fluid contained within the cylinder may leak. This can result in the cylinder providing a lesser amount of resistance than was possible when the cylinder was newly manufactured.

Based upon the above, it would beneficial to have an exercise device that is simple to position through reducing the overall weight of the exercise device, while providing a resistance mechanism that is easily adjustable, while maintaining the level of resistance associated with the exercise device over a long period.

BRIEF SUMMARY OF THE INVENTION

The present invention generally relates to an exercise device that is capable of being readily adjustable to provide variable resistance to an exerciser using the exercise device. The adjustable resistance of the exercise device may be easily and efficiently modified through simply operating a handle mechanism, repositioning the handle mechanism to a new position, and subsequently releasing the handle mechanism to set the resistance for the exercise device. This provides an exercise device that may be easily adjusted without the need to remove pins, reposition a resistance mechanism or weights upon the device, or reposition a pin or other fastener removed from the exercise device. Additionally, the exercise device is adapted to provide a resistance assembly that has compact characteristics, thereby limiting the overall space required or associated with the exercise device.

According to one embodiment of the present invention, the exercise device includes a frame that at least partially supports at least one exercise mechanism, such as (i) a leg exerciser or (ii) overhead handles that may be used to perform exercises. A connecting system, such as a cable and pulley system connects the exercise mechanism to a resistance assembly that is coupled to the frame. The resistance assembly provides resistance to the motion of the exercise mechanisms and hence resistance to the motion of the user exercising with the exercise device.

The resistance assembly includes: (i) a pivoting arm pivotally coupled to the frame; (ii) an actuating assembly that engages the pivoting arm; and (iii) at least one extendible, resilient resistance member. Resistance levels of the exercise device may be selected as a user moves the actuating assembly relative to the pivoting arm. The closer the actuating assembly is to the pivoting axis of the arm, the lower the level of resistance provided to the user's motion. Inversely, the further the actuating assembly is from the pivoting axis of the arm, the higher the level of resistance provided to the user's motion.

In one embodiment, the actuating assembly couples to a resilient resistance member such as a rubber band or spring that is coupled to the frame. The resilient member resists movement of the actuating assembly and consequently of the pivoting arm. By employing the resilient member, the use of a shock is avoided. Furthermore, the resilient member is strategically oriented so that the resistance assembly is compact and highly efficient.

The actuating assembly includes a handle mechanism that is simple to operate and enables a user to easily select a desirable resistance level. The handle mechanism includes a fixed member and a moveable member pivotally connected to the fixed member and biased from the fixed member. Disposed at an end of the moveable member is an engagement member that is adapted to cooperate with at least one aperture formed in the pivoting arm. As a user overcomes the biasing force between the fixed member and the moveable member, the engagement member is removed from an aperture to allow movement of the handle mechanism relative to the arm. When a new resistance level is selected, such as when the handle mechanism has been moved to a selected position on the arm, a user may allow the biasing force to move the moveable member relative to the fixed member to position the engagement member within another aperture. This positioning of the engagement member within another aperture locks the position of the handle mechanism and hence sets the selected resistance level.

Extending from the handle mechanism is a connecting member. The connecting member cooperates with the resilient resistance member and functions to move a moveable end of the resistance member as a user moves the operable mechanism. The position of the handle mechanism upon the pivoting arm and the amount that the connecting system is moved governs the amount of movement of the resistance member's moveable end. With the handle mechanism close to the pivotal axis of the arm, the amount of movement of the resistance member's moveable end is small and so the level of resistance is small. Similarly, with the handle mechanism being distant from the pivotal axis of the arm, the amount of movement of the resistance member's moveable end is large and so the level of resistance is large. A variety of resistance selections in between are also available.

According to another embodiment of the present invention, the exercise device includes a motorized resistance assembly. The resistance assembly includes an arm assembly pivotally connected to a frame of the exercise device. The arm assembly includes an arm with one or more arced surfaces that cooperate with a connecting assembly of the exercise device. A cross member of the connecting assembly slides along the arced surfaces as a motor rotates a drive member connected to the arm. As the cross member moves along the drive member, the position of at least one connecting member relative to at least one resistance member changes. The position of the cross member and/or the connecting member defines the resistance level of the resistance assembly.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
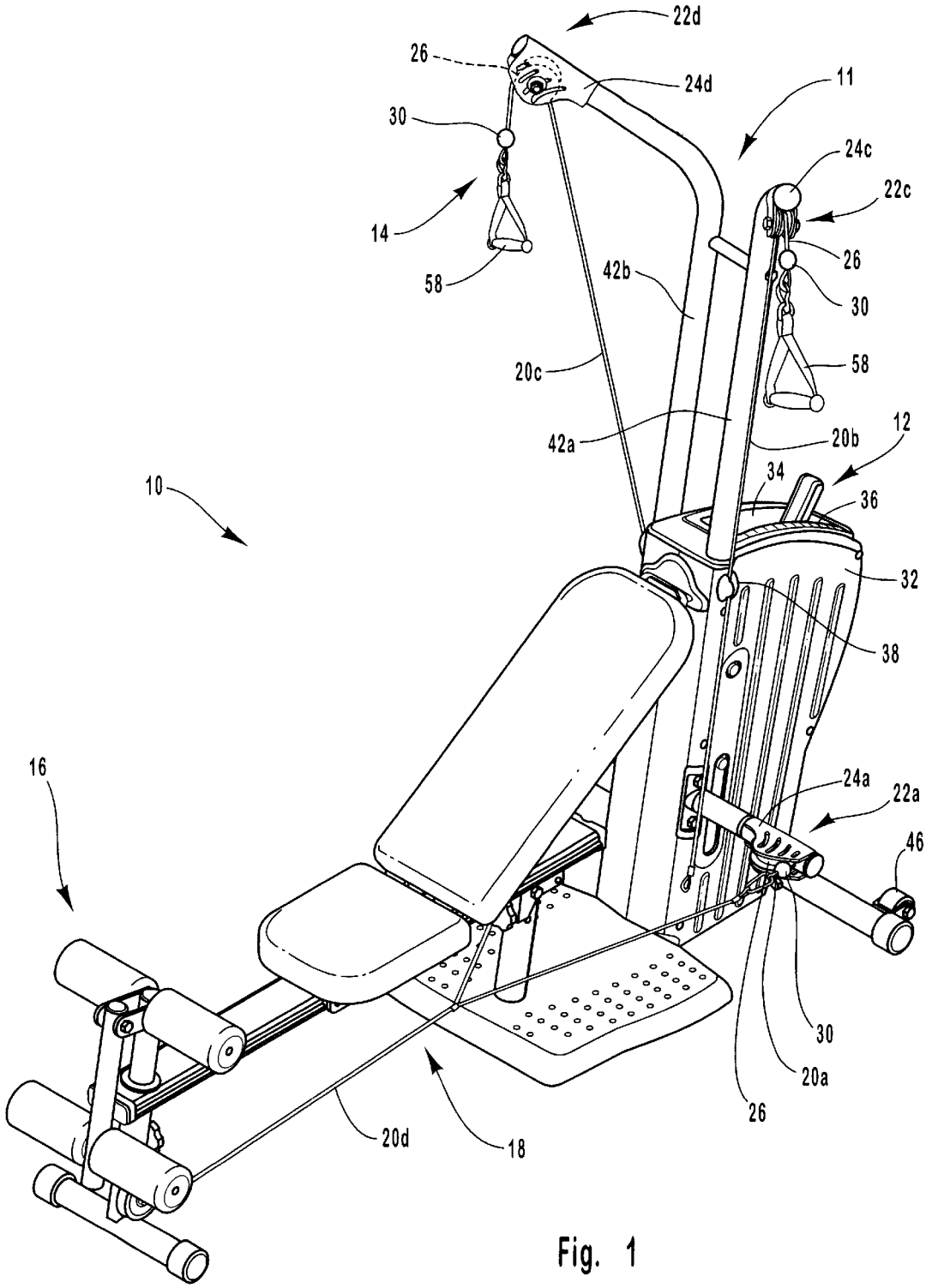
FIG. 1 illustrates a perspective view of an exercise device in accordance with one embodiment of the present invention.

The present invention generally relates to an exercise device that has an adjustable resistance assembly that provides resistance to an exercising user as he or she manipulates the exercise mechanisms of the exercise device. This resistance assembly provides a simple and efficient manner by which the user may select different resistances, without the possibility of loosing pins or other elements that are typically used to select a particular resistance. The configuration of the resistance assembly is compact, thereby limiting the overall space required or associated with the exercise device. With reference now to FIG. 1, depicted is one configuration of an exercise device according to one aspect of the present invention.

Exercise device 10 comprises: (i) a frame 11; (ii) at least one exercise mechanism (such as over head handle pull down mechanism 14 and leg exercising mechanism 16); (iii) a resistance assembly 12 that couples to frame 11; and (iv) a connecting mechanism 18 that couples the at least one exercise mechanism, e.g., mechanisms 14 and 16 to the resistance assembly 12. Resistance assembly 12 controls the amount of resistance encountered by a user exercising with exercise mechanisms 14 and 16.

With reference now to FIGS. 1, 2*a*, 2*b*, and 3, resistance assembly 12 includes: (i) a pivoting arm 110 pivotally coupled to frame 11; (ii) an actuating assembly 112 that engages pivoting arm 110; and (iii) at least one and preferably first and second extendible, resilient resistance members 114*a*, 114*n*. Connecting mechanism 18 of FIGS. 1–10 is a cable and pulley system or assembly that couples the at least one exercise mechanism, e.g., mechanisms 14 and 16 to the resistance assembly 12, such that the second end of arm 110 cooperates with the exercise mechanism so that movement of the exercise mechanism moves the arm 110.

Frame 11, cable and pulley system 18, and exercise mechanisms 14, 16 will now be discussed in additional detail. Frame 11 comprises (i) a base 44; and (ii) first and second upstanding members 42*a*, 42*b* extending upwardly from base 44. Base 44 may include one or more wheels 46 that may aid with positioning exercise device 10. Various portions of frame 11 may be hollow so that connecting system 18 may be at least partially disposed therein.

Cable and pulley system 18 comprises at least one and preferably a plurality of cables and at least one and preferably a plurality of pulley stations. In the embodiment shown, system 18 comprises a primary cable 20*a* that extends from pulley station 22*a* to pulley station 22*b* and passes through resistance assembly 12. Pulley stations 22*a* and 22*b* are mounted to frame 11 by supports 28*a* and 28*b*. Secondary cables 20*b* and 20*c* couple to respective ends of primary cable 20*a* and extend upwardly and through respective pulley stations 22*c* and 22*d*. Tertiary cable 20*d* couples to leg exercise mechanism 16 and couples to at least one of the ends of primary cable 20*a*, preferably forking so as to couple to both ends of cable 20*a*.

Each end of cable 20*a*, and the terminating ends of cables 20*b*–20*c*, includes a stop 30 that prevents the end of the cable passing through the respective pulley stations 22*a*–22*d* toward resistance assembly 12 during performance of an exercise. Cable of the present invention may be comprised of metallic material, rope, string, or other materials that are capable of functioning as described herein.

Each pulley station 22*a*–22*d* includes a pivoting member 24*a*–24*d*, respectively, that supports one or more pulleys 26. As a user moves first exercise mechanism 14, for instance, pivotal member 24*d* moves to position pulley 26 so that cable 20*d* slides along pulley 26.

Disposed at a top of frame 11 is first exercise mechanism 14. The first exercise mechanism 14 enables an exercising user to perform exercises using the user's arms. Handles 58 are attached to respective cables 20*b*, 20*c*. The pivoting properties of pulley stations 22*a*–22*d* enable the user to move handle 58 relative to frame 11, while cable 20*a*–*c* remains in engagement with respective pulley 26.

Figure 2A:
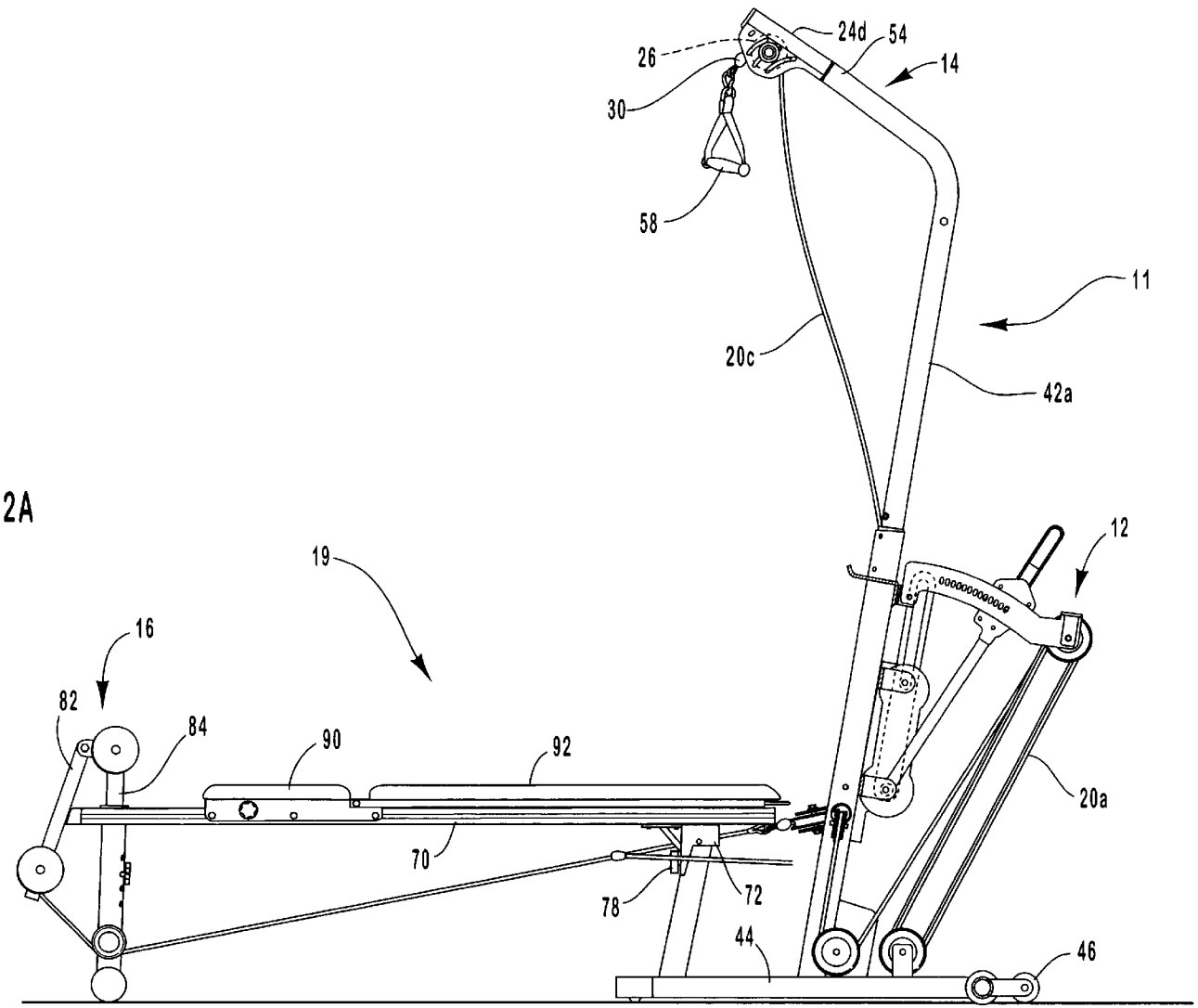
FIG. 2A illustrates a side view of the exercise device of FIG. 1 with a second exercise mechanism in an exercising position.
Figure 2B:
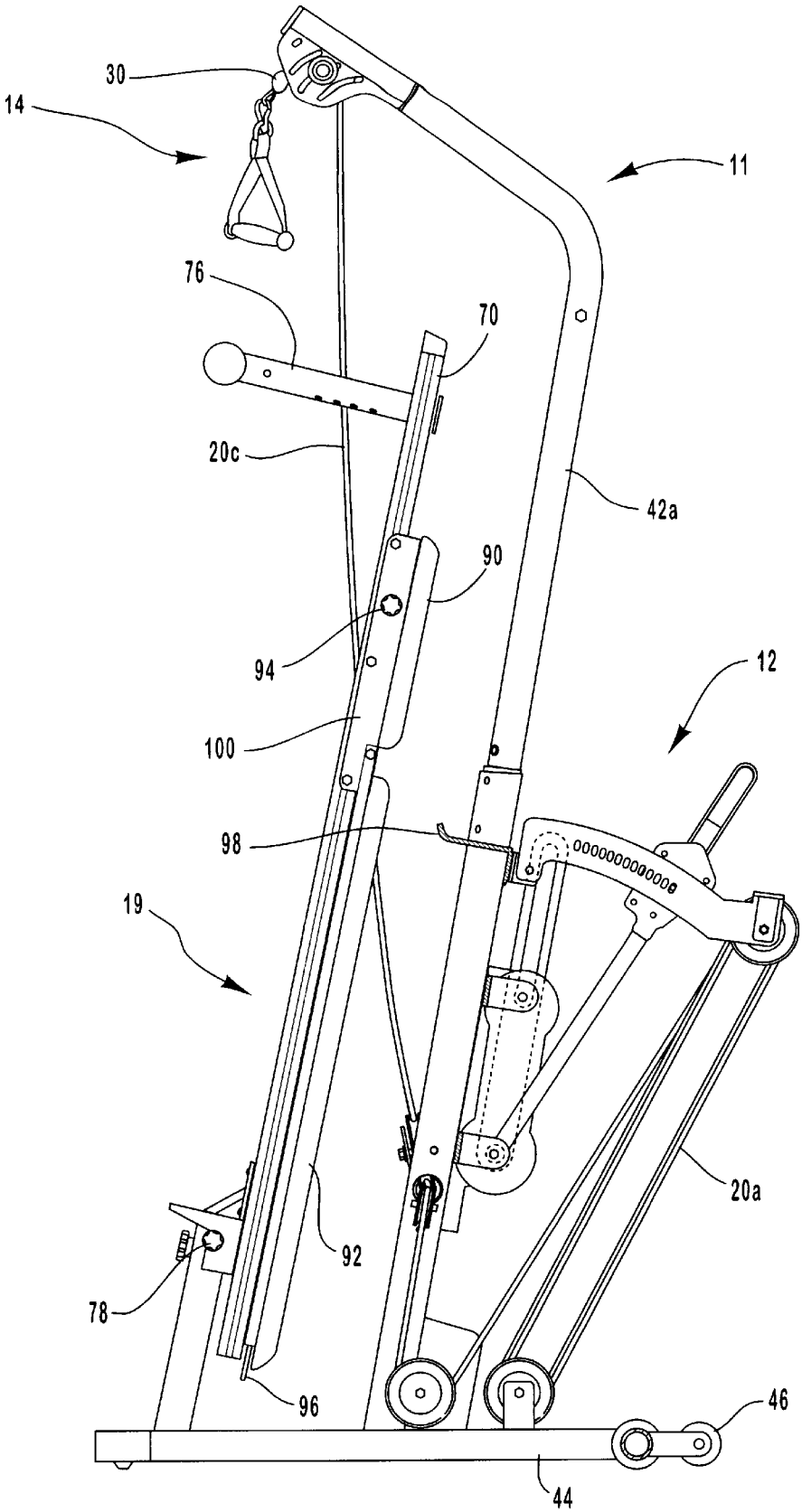
FIG. 2B illustrates a side view of the exercise device of FIG. 1 with a second exercise mechanism in a storage position.

With continued reference to FIG. 2A, mounted to base 44 is second exercise mechanism 16 is shown coupled to pivoting bench assembly 19. Bench assembly 19 includes an elongate member 70 pivotally mounted to base 44 by way of a bracket 72. This bracket 72 allows elongate member 70 to be positioned in an exercising position where elongate member 70 is generally parallel to a surface upon which exercise device 10 is disposed and a storage position, shown in the partial view of exercise device 10 depicted in FIG. 2B, where elongate member 70 is generally perpendicular to a surface upon which exercise device 10 is disposed. Bracket 72 may be secured in either the exercising position or the storage position through use of a locking member 78 that passes through bracket 72 to cooperate with extension member Cooperating with elongate member 70 is a seat 90 and a backrest 92 upon which a user may sit or incline as he or she uses first exercise mechanism 14 and/or second exercise mechanism 16. The seat 90 may be slidably positioned upon elongate member 70 to accommodate user of various sizes. The backrest 92 may be inclined and optionally cooperate with frame 11.

Also attached to elongate member 70 at a location distant from bracket 72 is exercise mechanism 16 in the form of a leg developer assembly having a leg lever 82 pivotally coupled to a leg lever support 84. The leg lever 82 connects to, in one embodiment, resistance assembly 12 by way of pulley station 22*a* and cable 20*d*.

Resistance assembly 12 will now be described in additional detail. As illustrated in FIG. 1, resistance assembly 12 is at least partially enclosed by a housing 32. Discussion of housing 32 will be made with respect to one side of housing 32, however, it is contemplated that the other side of housing 32 is generally a mirror image of the described housing. The housing 32 includes a hole 34 that enables a user to access resistance assembly 12. The housing 32 may optionally include one or more indicia 36 that may be used with resistance assembly 12 to identify the particular level of resistance at which resistance assembly 12 may be set. The housing 32 may optionally include cable guides 38 that may receive cables 20*b* and 20*c* and securely retain the same therein.

Figure 3:
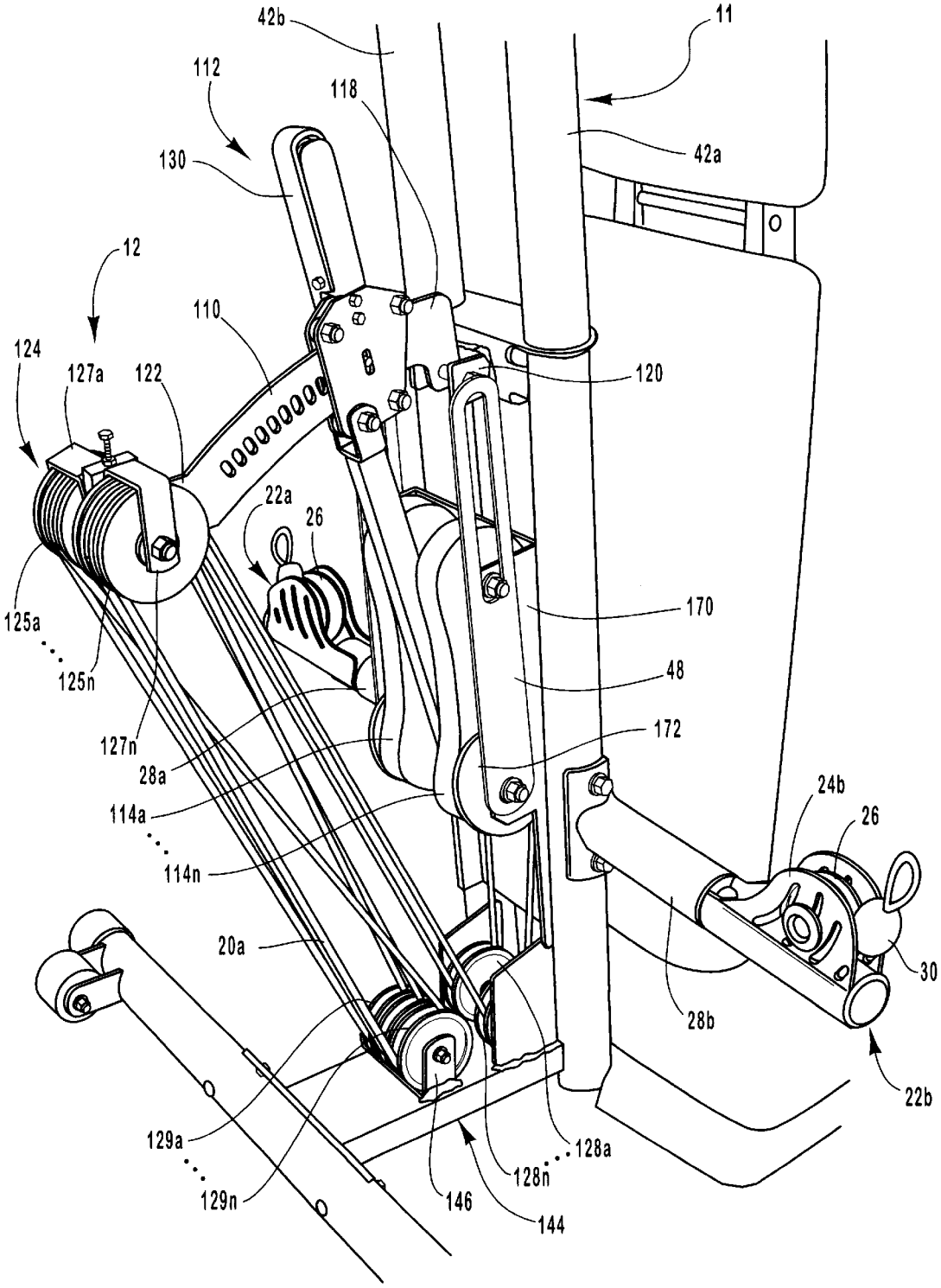
FIG. 3 illustrates a perspective view of a portion of a resistance assembly of the exercise device of FIG. 1.

With continued reference to FIGS. 1–3, resistance assembly 12 includes a resistance arm 110 that is pivotally coupled to frame 11 and is movably coupled to actuating assembly 112. The resistance arm 110 is pivotally attached to a mounting member 120 (FIG. 4) of frame 11. The second end 122 of resistance arm 110 moves as a user exercises using exercise device 10. Arm 110 is depicted as having a generally curved profile. However, one skilled in the art may appreciate that arm: 110 may have various other configurations to perform the functions described herein.

A first end 118 of arm 110 is pivotally coupled to frame 11. A second end 122 of arm 110 has a pulley assembly 124 therein that receives cable 20*a* about its one or more pulleys 125*a*–125*n*, which are mounted to second end 122 by one or more brackets 127*a* and 127*n*. Cable 20*a* extends from pulley station 22*b* to pulley station 22*a* after being received by one or more intermediate pulleys 128*a*–128*n*, pulley assembly 124, and a base pulley assembly 144 that is mounted to base 44 by bracket 146.

In the illustrated configuration, cable 20*a* extends from pulley station 22*b*, through one or more of intermediate pulleys 128*a*–128*n* mounted to frame 11. This cable 20*a* continues from intermediate pulleys 128*a*–128*n* to be received at pulley assembly 124 and associated the one or more pulleys 125*a*–125*n*. Extending from pulley assembly 124, cable 20*a* is received by a base pulley assembly 144 that also includes one or more pulleys 129*a*–129*n*. This cable 20*a* then optionally repeatedly extends from pulley assembly 144 to pulley assembly 124 and then passes to other similar intermediate pulleys 128*a*–128*n*, before terminating at pulley station 22*a*. As an exerciser moves both of the handles of first exercise mechanism 14 (FIG. 1), for example, the available length of cable 20*a* extending between pulley assembly 124 and pulley assembly 144 shortens. This shortening of the available portion of cable 20*a* causes pulley assembly 124 to move toward pulley assembly 144, thereby resulting in arm 110 pivoting about mounting member 120. This movement causes actuating assembly 112 to move resistance members 114*a*–114*n* that limit the motion of arm 110, thereby providing resistance to the exercising user.

Returning to FIG. 2*a,* in the illustrated configuration, an exercising user may receive resistance from resistance assembly 12 when the user exercises with both handles 58 associated with first exercise mechanism 14 (FIG. 1) or a single handle 58 associated with first exercise mechanism 14. This occurs because movement of one end of cable 20*a* results in a shortening of the available length of cable 20*a* between pulley assembly 124 and pulley assembly 144.

Figure 4:
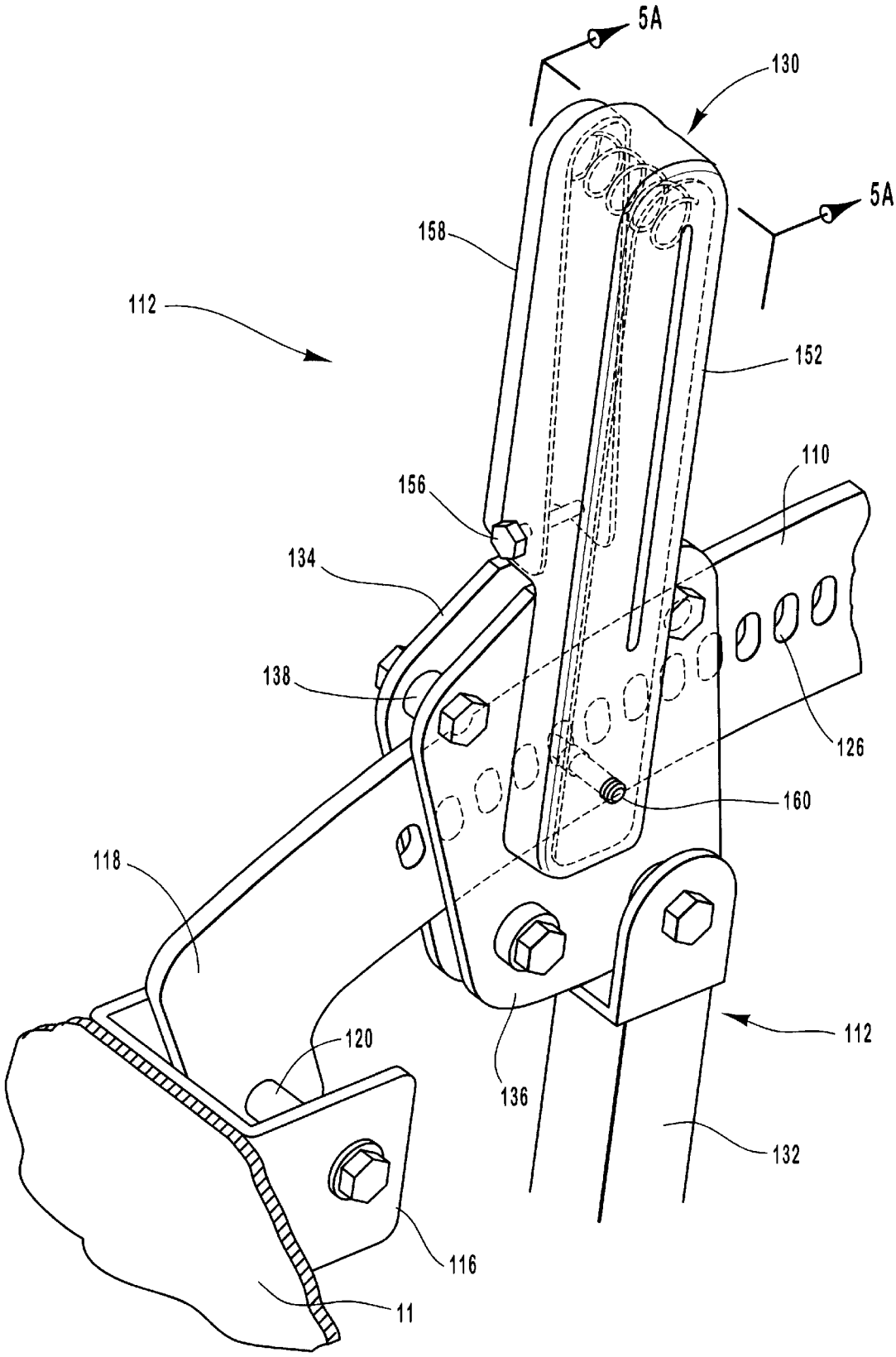
FIG. 4 illustrates a perspective view of a portion of an actuating assembly of the exercise device of FIG. 1.

Disposed between first end 118 and second end 122 of arm 110 are one or more apertures 126, as illustrated in FIG. 4. Apertures 126 are adapted to cooperate with actuating assembly 112 to define different resistance levels. Each aperture 126 defines a different resistance level. By varying the spacing of apertures 126, one may provide an exercise device that has a small incremental change in the resistance level from one aperture to an adjacent aperture or an exercise device that has a large incremental change in the resistance level from one aperture to another. In this manner, the present invention provides exercise devices that may be configured to provide numerous various incremental steps of resistance level.

The actuating assembly 112 includes a handle mechanism 130 and a connecting member 132. The actuating assembly 112 allows a user to select a particular resistance that the user encounters while exercising using exercise device 10. More specifically, a user of exercise device 10 may manipulate handle mechanism 130 to slidably move handle mechanism 130 relative to arm 110. Movement of handle mechanism 130 enables a user to set different resistance values or levels that the user with encounter while exercising using exercise device 10. As handle mechanism 130 moves along arm 110 the angular orientation of connecting member 132 relative to resistance members 114*a*–114*n* (FIG. 3A) changes.

The handle mechanism 130 includes a first plate 134 and a second plate 136. First plate 134 and second plate 136 are disposed on opposite sides of arm 110. First plate 134 and second plate 136 may be connected one to another using a variety of different mechanisms, such as by one or more fasteners, so long as first plate 134 and second plate 136 are separated sufficiently to allow arm 110 to be disposed there between. For instance, one or more spacers 138 may be used to separate first plate 134 and second plate 136 to maintain the desired displacement one or another.

Figure 5A:
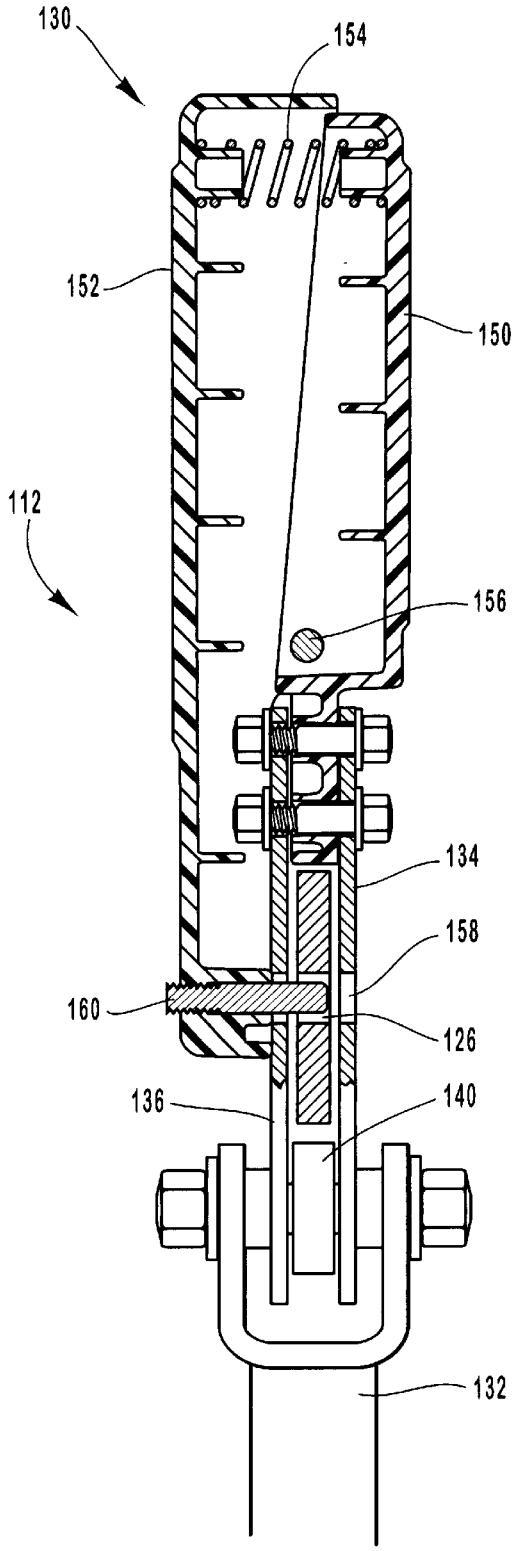
FIGS. 5A and 5B illustrate a partial cross-sectional view of the portion of the actuating assembly of FIG. 4 demonstrating the selective movement of the handle in order to selectively move the actuating assembly.
Figure 5B:
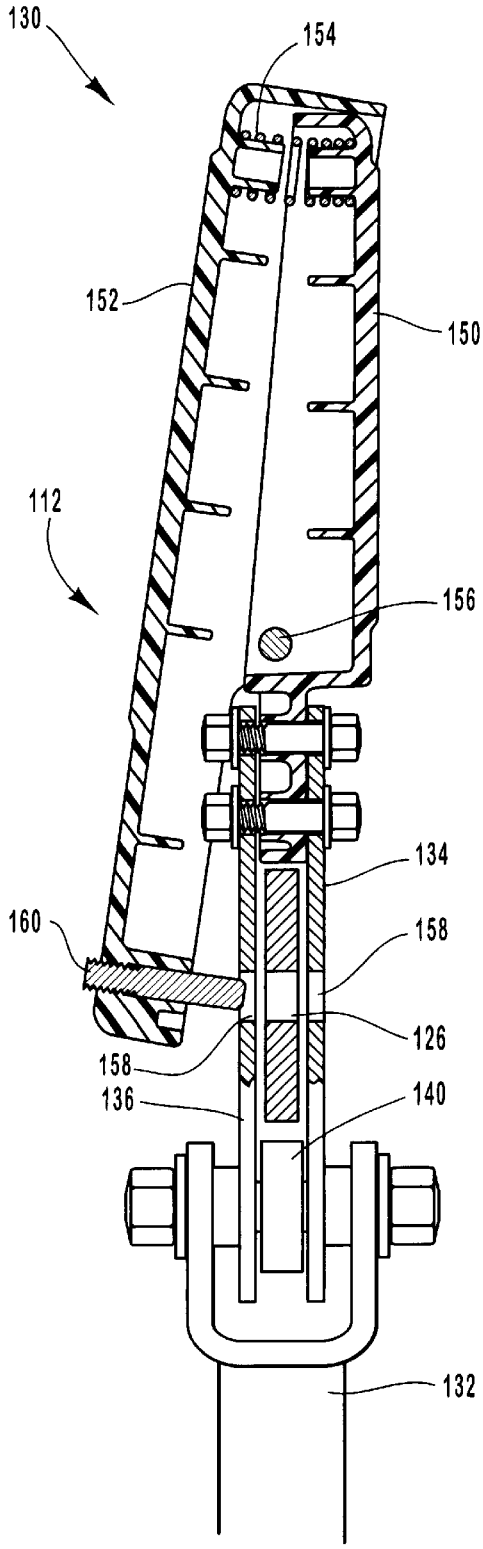

A lower portion of each plate 134, 136 is adapted to cooperate with connecting member 132 and optionally with a fixed member 150 and a moveable member 152. Additionally, the lower portions of each plate 134, 136 are adapted to retain a wheel 140, as illustrated in FIGS. 5A and 5B. Wheel 140 engages with a portion of arm 110 and allows actuating assembly 112 to slide along or translate along arm 110. It may be appreciated that wheel 140 is only one embodiment of the structure capable of performing the function of means for aiding with translating actuating assembly along arm 110. For instance, in another configuration, wheel 140 may be substituted with a friction-reducing block or other element that allows actuating assembly 112 to move along arm 110.

With continued reference to FIGS. 5A and 5B, attached to first plate 134 is fixed member 150 of handle mechanism 130. Pivotally connected to fixed member 150 by way of pivot member 156 is a moveable member 152. The pivot member 156 may having the form of a fastener, a pin, or other structure capable of performing the function of member about which moveable member 152 pivots.

The moveable member 152 is spring biased with respect to fixed member 150. Biasing of moveable member 152 may be achieved through use of a spring 154. Although reference is made to spring 154, it can be appreciated by one skilled in the art that various other structures may be used to bias moveable member 152 relative to fixed member 150. For instance, and not by way of limitation, other resilient members may be disposed or substituted for spring 152.

Disposed at an end of moveable member 152 is an engagement member 160. The engagement member 160, such as a pin, is adapted to cooperate with apertures 126 of arm 110 and with associated apertures 158 in first plate 134 and/or second plate 136. Although depicted as threadably engaging the end of moveable member 152, one skilled in the art may appreciate that engagement member 160 may be integrally formed with moveable member 152 or connected to moveable member 152 using one or more structures capable of performing the function of means for connecting one member to another member.

In operation, by moving moveable member 152 relative to fixed member 150, as is shown in FIG. 5B, engagement member 160 is removed from engaging with aperture 126 to allow a user to traverse arm 110 to a desired location and to set a desired resistance. For instance, handle mechanism 130 may be moved until fixed member 150 aligns with a desired one of indicia 36 (FIG. 1) on housing 32. The engagement member 160 may optionally be removed completely from aperture 158 in first plate 134 or second plate 136, however, maintaining engagement member 160 within aperture 158 but removed from aperture 126 may aid with aligning engagement member 160 with aperture 160 when the biasing force is allowed to position engagement member 160 into aperture 126.

In one embodiment, when the user positions handle mechanism 130 of actuating assembly 112 at a desired position, i.e., indicators upon or handle mechanism 130 itself align with complementary indicators 36 (FIG. 1) upon housing 32, the user releases handle mechanism 130 to lock the selected resistance for exercise device 10, as is illustrated in FIG. 5A. By merely gripping handle mechanism 130 sufficiently to release the same, a user may move handle mechanism 130 to different resistance levels in a simple and efficient manner.

Figure 6:
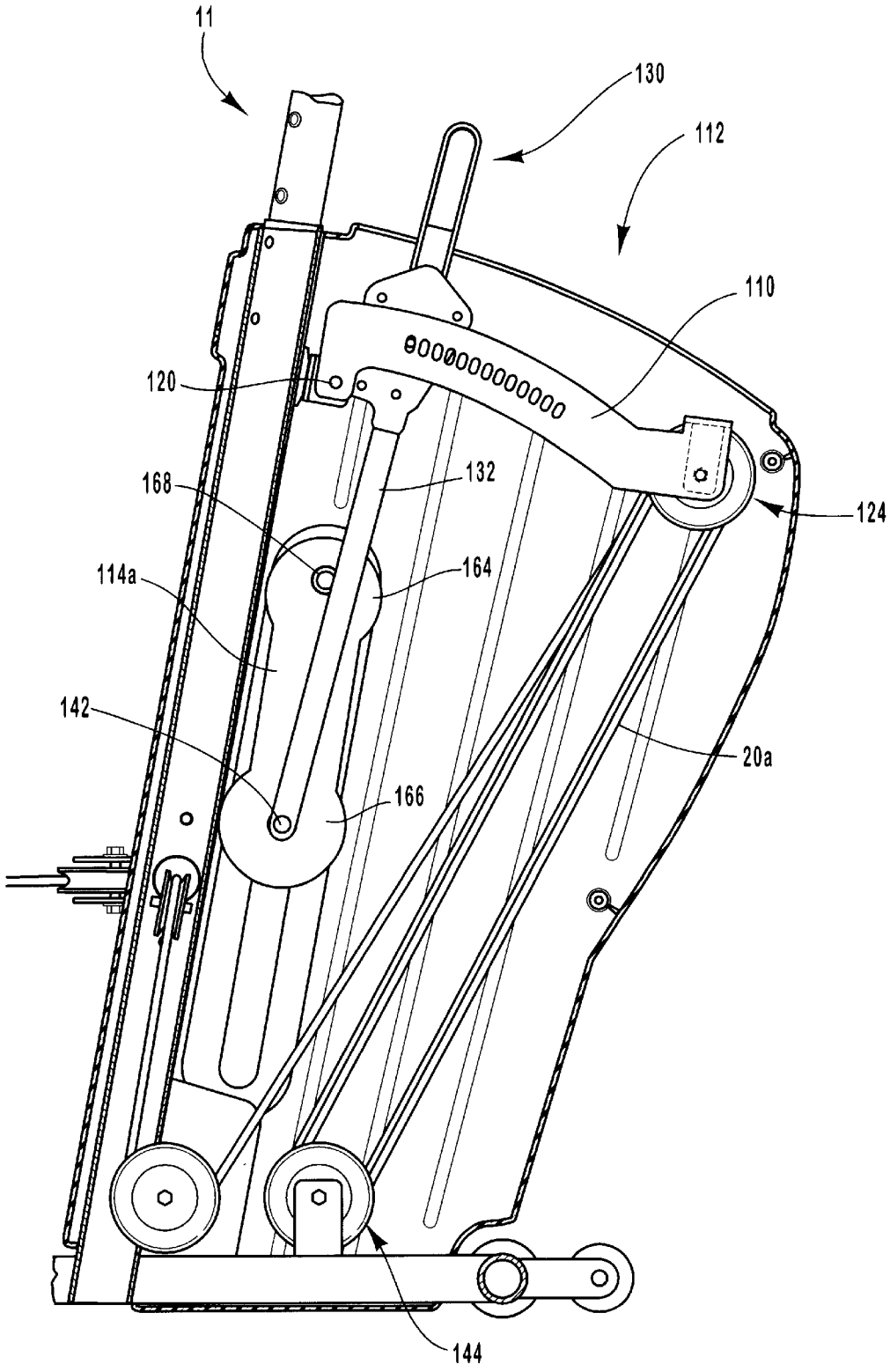
FIG. 6 illustrates a partial cross-sectional view of a resistance assembly of the exercise device of FIG. 1 with the actuating assembly located at a first position closest to a pivotal axis of an arm of the resistance assembly.

With reference now to FIG. 6, connecting member 132 extends from handle mechanism 130 to resistance members 114*a*–114*n*. In the illustrated configuration, connecting member 132 connects to a support member 142 upon which resistance members 114*a*–114*n* are disposed. In this manner, movement of support member 142 under the influence of connecting member 132 moves a portion of each resistance member 114*a*–114*n* simultaneously. In other configurations, one or more connecting member 132 may connect to one or more resistance member 114*a*–114*n* with or without support member 142.

Figure 7:
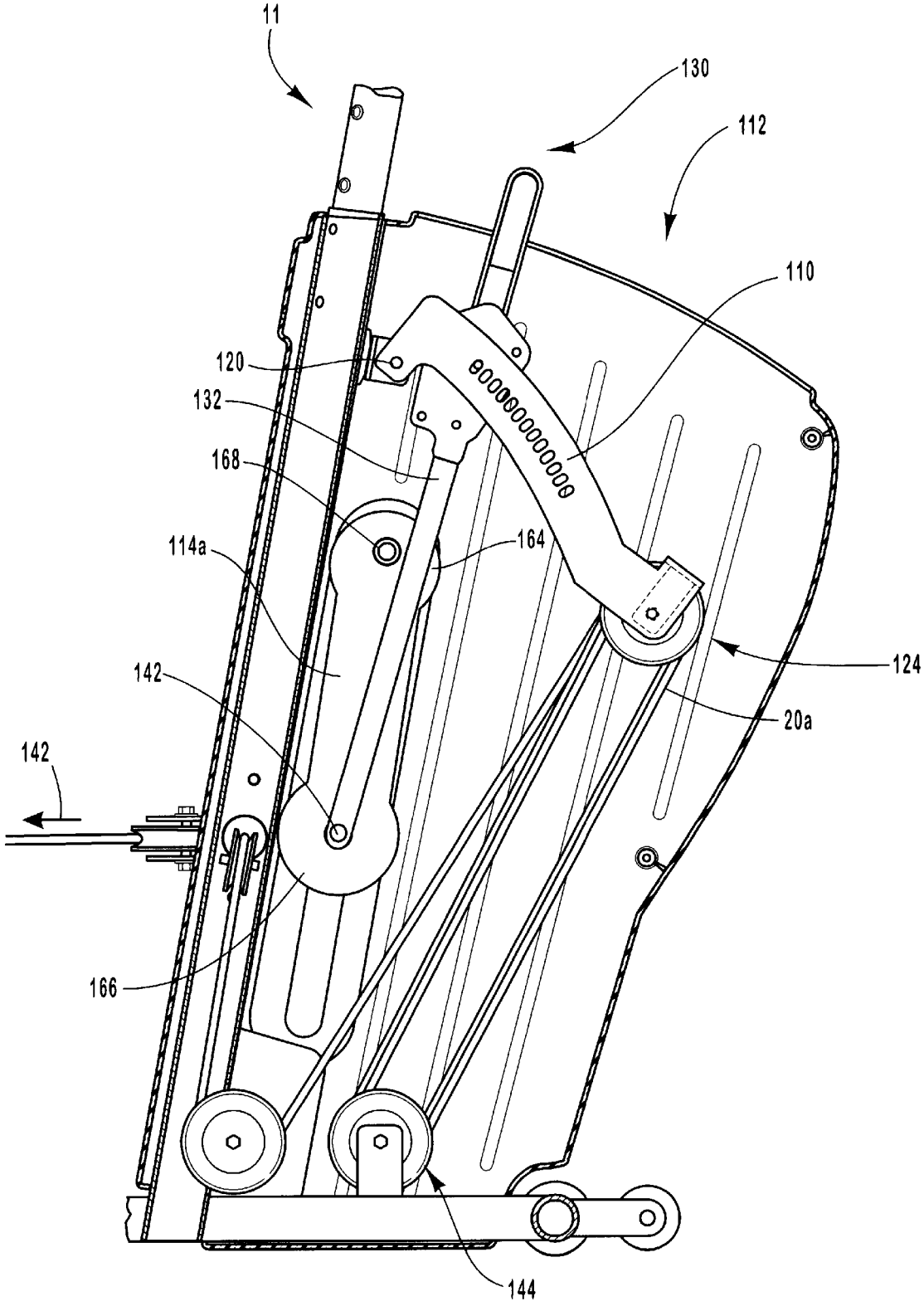
FIG. 7 illustrates a partial cross-sectional view of the resistance assembly of the exercise device of FIG. 1 as an exercise mechanism is manipulated.

Resistance members 114*a*–114*n* are adapted to provide resistance to the motion of arm 110 as a user pulls on one or more of cables 20*a*–20*d* (FIG. 1) connected to pulley assembly 124. To achieve this, in one configuration, a first end 164 of each resistance member 114*a*–114*n* is coupled to frame 11 at a location 168, while connecting member 132 may move a second end 166 of each resistance member 114*a*–114*n*. As arm 110 moves about a central axis of mounting member 120, when cable 20*a* is moved in the direction of arrow A in FIG. 7, pulley assembly 124 moves toward pulley assembly 144 and connecting member 132 moves second end 166 of each resistance member 114*a*–114*n*, such as depicted in FIG. 7. With each resistance member 114*a*–114*n* being resilient, the resiliency characteristics of each resistance member 114*a*–114*n* allow connecting member 132 to extend each resistance member 114*a*–114*n* under the force exerted by an exercising user. The resilient characteristics of each resistance member 114*a*–114*n,* however, enables each resistance member 114*a*–114*n* to return to its configuration prior to being extended by the force exerted by the exercising user, as is depicted in FIG. 6.

Generally, resistant members 114*a*–114*n* may have various configurations so long as they are capable of being temporarily stretched or lengthened under application of a force from a first configuration, while substantially returning to the first configuration following stretching or lengthening to the second configuration. Illustratively, each resistant member 114*a*–114*n* may be springs, elastomeric members (e.g., bone shaped rubber bands), or other materials or structures having sufficient resiliency. Additionally, resistant members 114*a*–114*n* may having any shape, such as, but not limited to, polygonal, curved, oval, bone-shaped, combinations thereof, or other shapes that may aid with providing resiliency.

The curved configuration of arm 110 allows differing levels of force to be selected by a user. The variations in resistance force result from the position of handle mechanism 130 relative to the pivoting axis of arm 110, i.e., the axis of mounting member 120. For instance, the lowest resistance levels occur when handle mechanism 130 is closest to mounting members 120, while the highest resistance levels occurs when handle mechanism 130 is closest to pulley assembly 124. This happens because handle mechanism 130, when positioned closest to mounting members 120, moves toward second end 166 of resistance members 114*a*–114*n* to a lesser degree than does handle mechanism 130 when handle mechanism 130 is positioned closest to pulley assembly 124. Since actuating assembly 112 has a fixed length, i.e., connecting member 132 has a fixed length, and is connected to second end 166 that acts as the center of the radius for the curve of arm 110, changes in the initial position of handle mechanism 130 relative to second end 166 of resistance members 114*a*–114*n* results in different stretching or lengthening of resistance members 114*a*–114*n* and hence the amount of resistance to the motion of the exercising user. Although reference is made to the second end 166 acting as the center of a curve to which arm 110 is matched when no force is applied to cable 20*a,* one skilled in the art may appreciate that various other center points and curve orientations are possible and may be used with the present invention.

Figure 8:
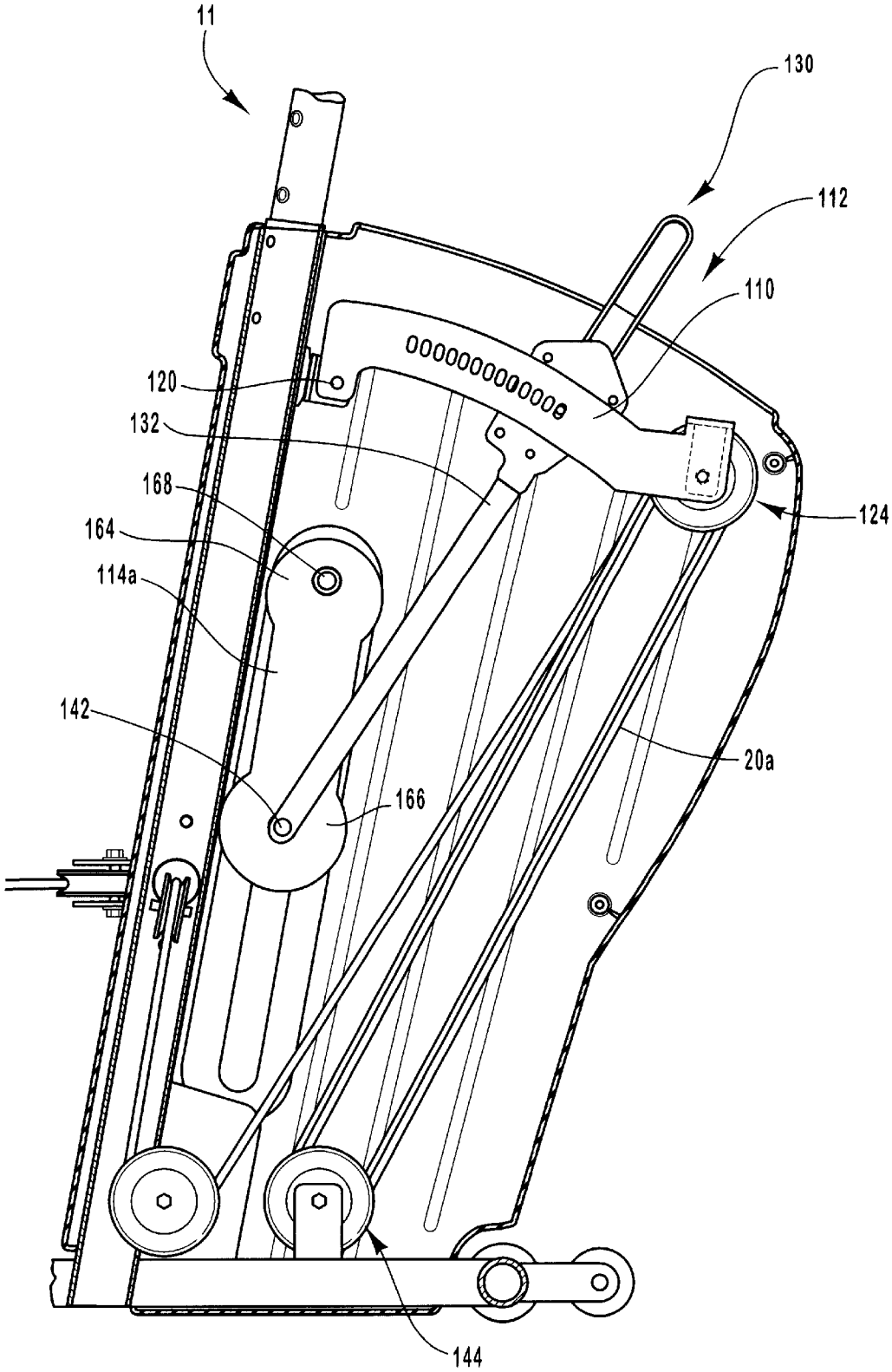
FIG. 8 illustrates a partial cross-sectional view of the resistance assembly of the exercise device of FIG. 1 with the actuating assembly located at a second position furthers from a pivot axis of an arm of the resistance assembly.
Figure 9:
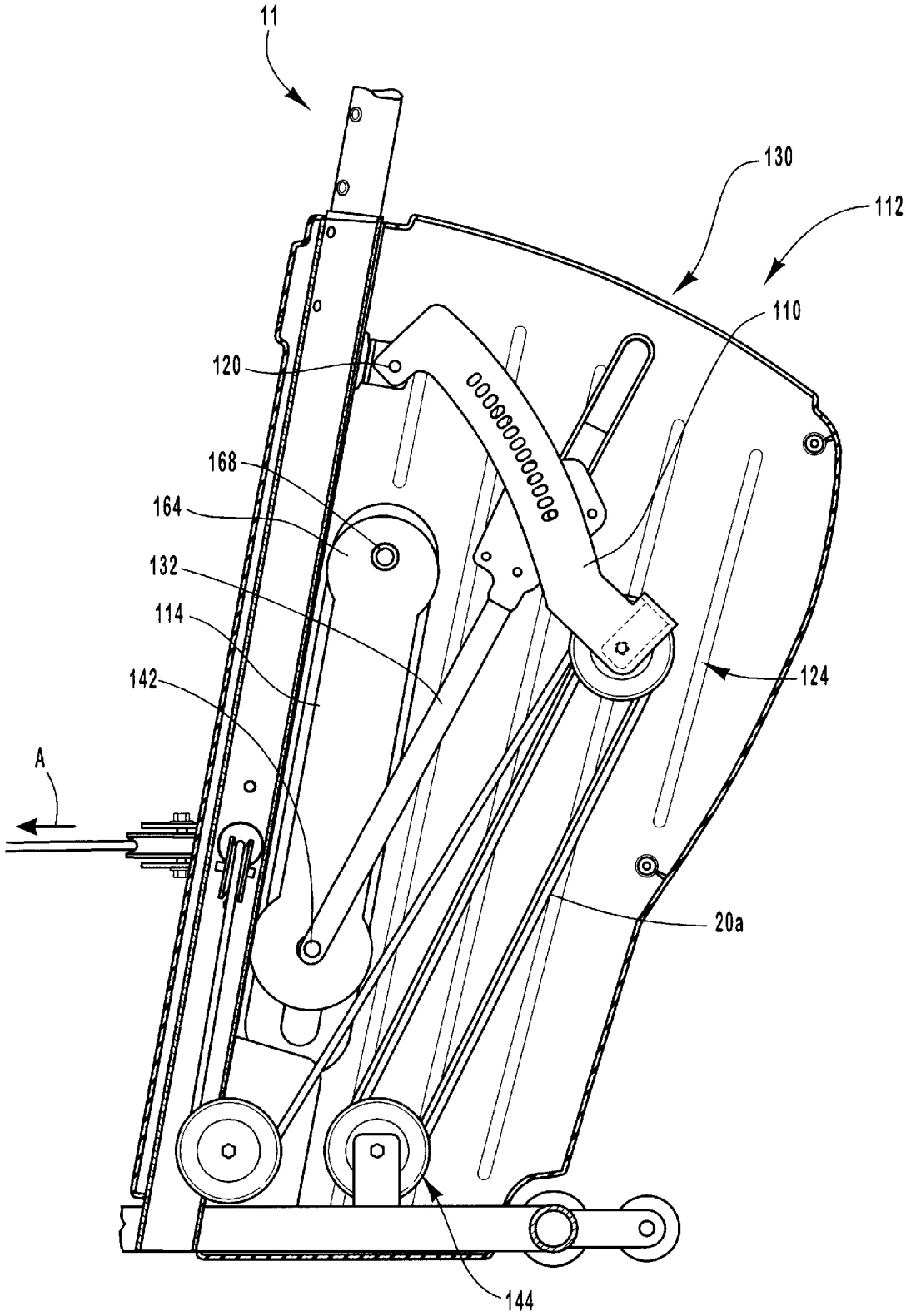
FIG. 9 illustrates a partial cross-sectional view of the resistance assembly of the exercise device of FIG. 1 as an exercise mechanism is manupulated.

The above affect may be seen with reference to FIGS. 6–9. For instance, FIGS. 6 and 7 illustrate resistance assembly 12 where handle mechanism 130 is positioned close to mounting member 120, while FIGS. 8 and 9 illustrate resistance assembly 12 where handle mechanism 130 is positioned close to pulley assembly 124. As cable 20*a* is moved during performance of an exercise, the shortening of available portion of cable 20*a* received by pulley assembly 124 and pulley assembly 144 causes arm 110 to pivot about mounting member 120. This movement results in connecting member 132 moving second end 166 of resistance members 114*a*–114*n* in a direction away from arm 110. The movement of second end 166 of resistance member 114*a*–114*n* is greater in FIG. 9 than in FIG. 6, resulting in a greater resistance force in the configuration of FIG. 9 than in the configuration of FIG. 6.

To aid with moving second end 166 of resistance members 114*a*–114*n,* frame 11 may include a track 170, as shown in FIG. 3. Track 170 provides a path for second end 166 of resistance members 114*a*–114*n* to follow as connecting member 132 moves second end 166. The track 170 may cooperate with a guide 172 that is. optionally coupled to second end 166 of each resistance member 114*a*–114*n* or one or more of resistance members 114*a*–114*n*. This guide 172 aids to maintain resistance. members 114*a*–114*n* within track 170 to prevent torquing or twisting of resistance member 114*a*–114*n* during stretching or lengthening. Various configurations of guide 172 are known to those skilled in the art. For instance, guide 172 may have a generally circular form to enable guide 172 to optionally roll as resistance members 114*a*–114*n* stretch. In another configuration, guide 172 may slidably mate with a slot (not shown) formed in the track. In this configuration, guide 172 may have a stepped configuration where a portion of guide 172 slides against the track, while another portion mates with the slot.

Figure 10:
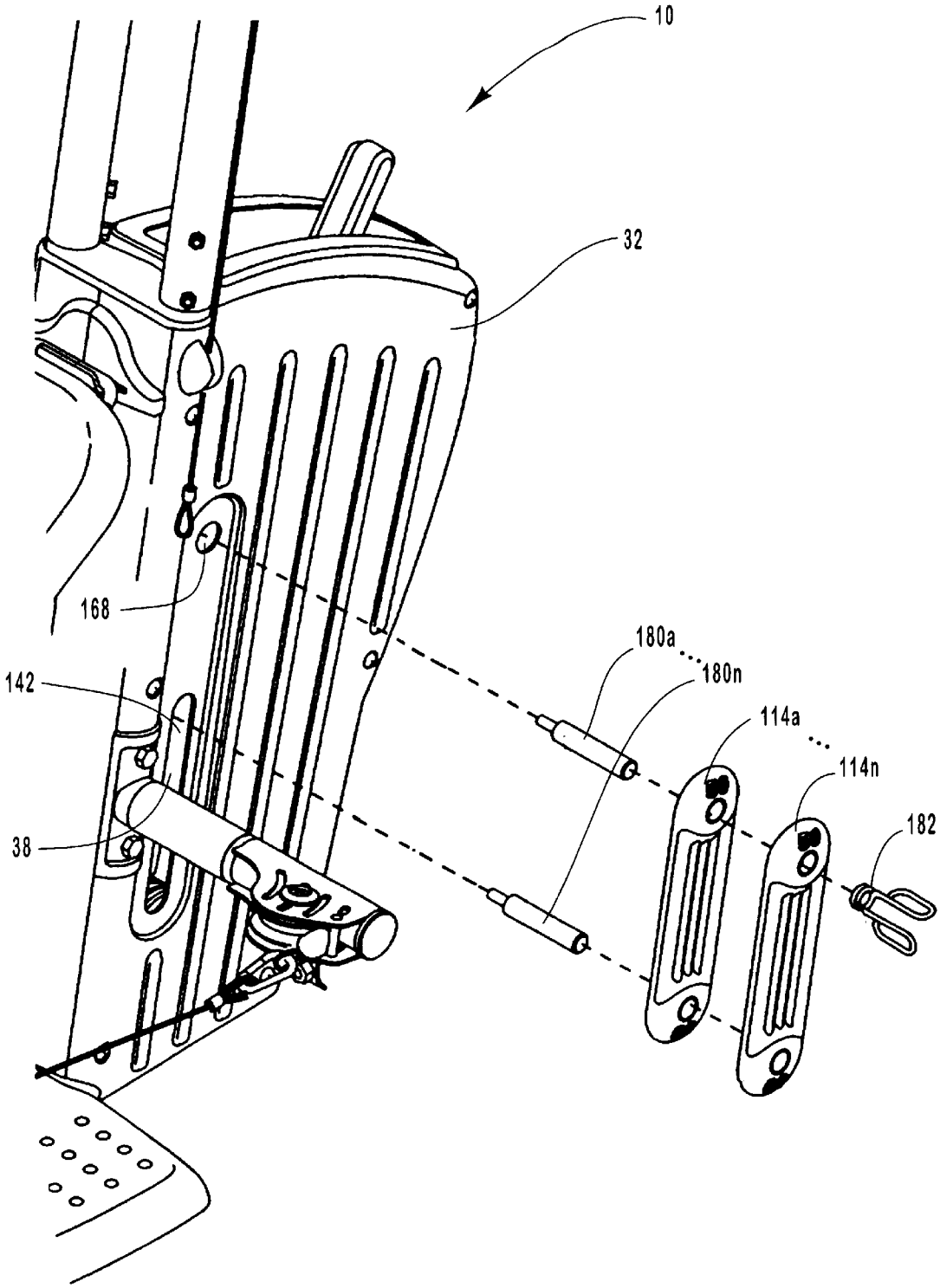
FIG. 10 illustrates a perspective view of one or more secondary support members that facilitate attachment of one or more additional resistance members according to another aspect of the invention.

In addition to the above, embodiments of the present invention enable additional resistance members to be coupled or otherwise added to the one or more resistance members 114*a*–114*n* disposed within housing 32 of exercise device 10. With reference to FIG. 10, exercise device 10 may include secondary support members 180*a*–180*n* that accommodate one or more additional resistance members 114*a*–114*n* to increase the possible resistance levels associated with exercise device 10. One or more of secondary support members 180*a*–180*n* may be mounted to support member 142 (FIG. 6) through a slot 38 in housing 32. The slot 38 allows the one or more of secondary support members 180*a*–180*n* to move as resistance members 114*a*–114*n* (FIG. 3) move within housing 32 under the influence of actuating assembly 112. This slot 38 may be partially covered by an interior cover 48 (FIG. 3) and move with resistance members 114*a*–114*n* (FIG. 3).

The upper secondary support members 180*a* may be mounted to the frame (not shown) at location 168, thereby providing a fixed point attachment for the additional resistance members 114*a*–114*n*. The lower secondary support members 180*n* may threadably connect within opposing ends of support member 142 (FIG. 6). Although reference is made to secondary support members 180*a*–180*n* threadably connecting with support member 142, one skilled in the art may appreciate that other manners of connecting the secondary support members to the support member. For instance, and not by way of limitation, the secondary support members may be slip-fit, friction fit, releasable lock-fit, or otherwise connected to the support member using a means for connecting one member to another member.

In another configuration, one or more of secondary support members 180*a*–180*n* may mate with connecting member 132 (FIG. 6) rather than support member 142. Similarly, secondary support members 180*a*–180*n* may optionally mate directly with one or more of resistance members 114*a*–114*n* (FIG. 3).

To maintain resistance members 114*a*–114*n* upon secondary support members 180*a*–180*n,* one or more fastening members 182 cooperate with one or more of secondary support members 180*a*–180*n*. These fastening members 182 lock resistance members 114*a*–114*n* upon secondary support members 180*a*–180*n* and prevent inadvertent removal of the same. The fastening members 182 may be spring loaded members that are configured to mate with an exterior surface of secondary support members 180*a*–180*n*. Other configurations of fastening members 182 are known to those skilled in the art.

Figure 11A:
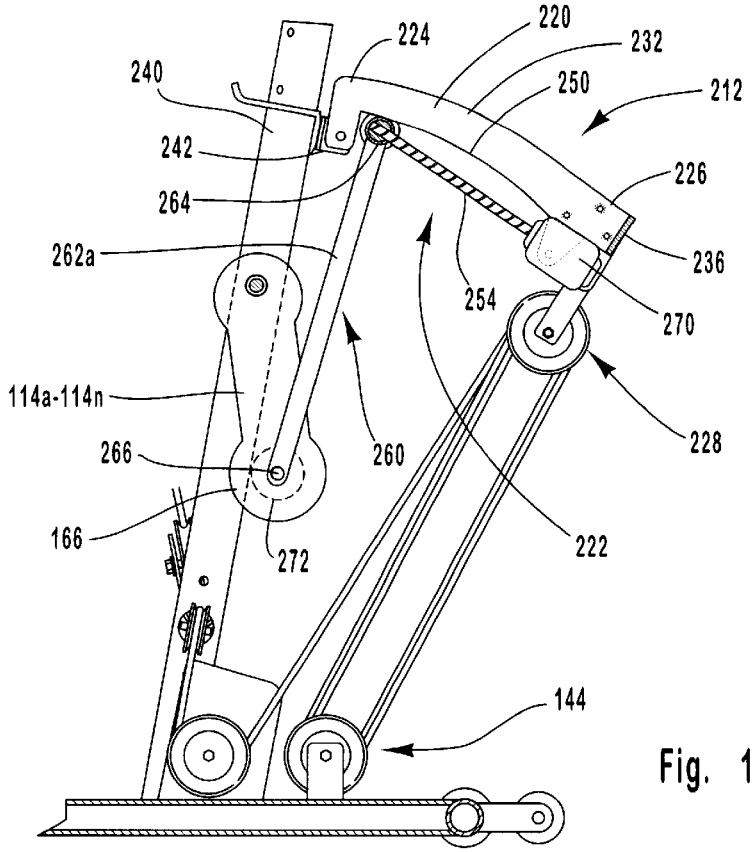
FIGS. 11A and 11B illustrates partial cross-sectional views of a resistance assembly featuring a motorized resistance member according to another aspect of the invention.
Figure 11B:
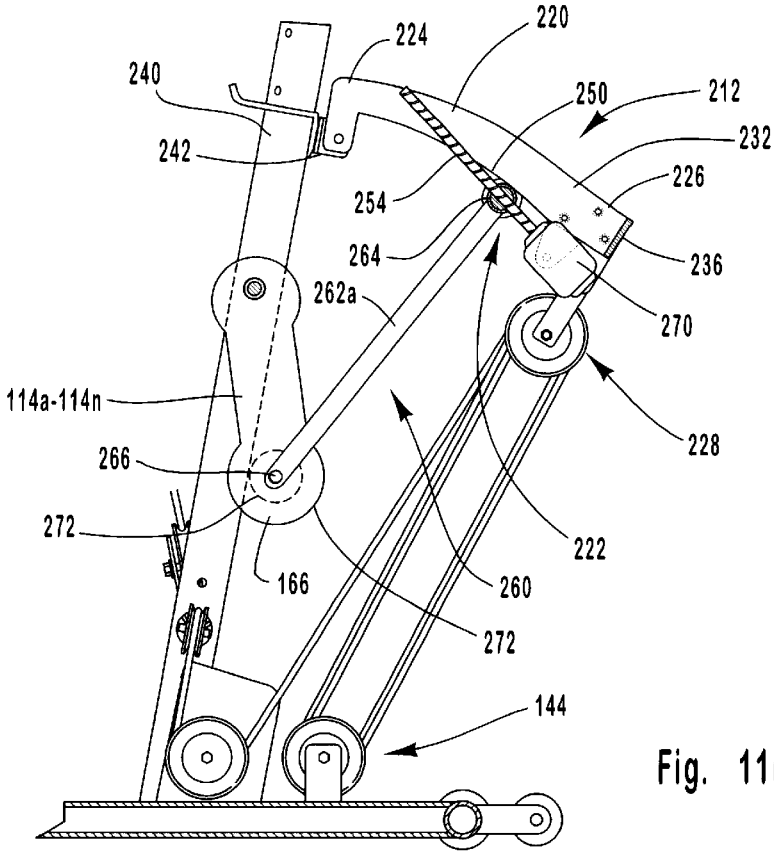
Figure 4:
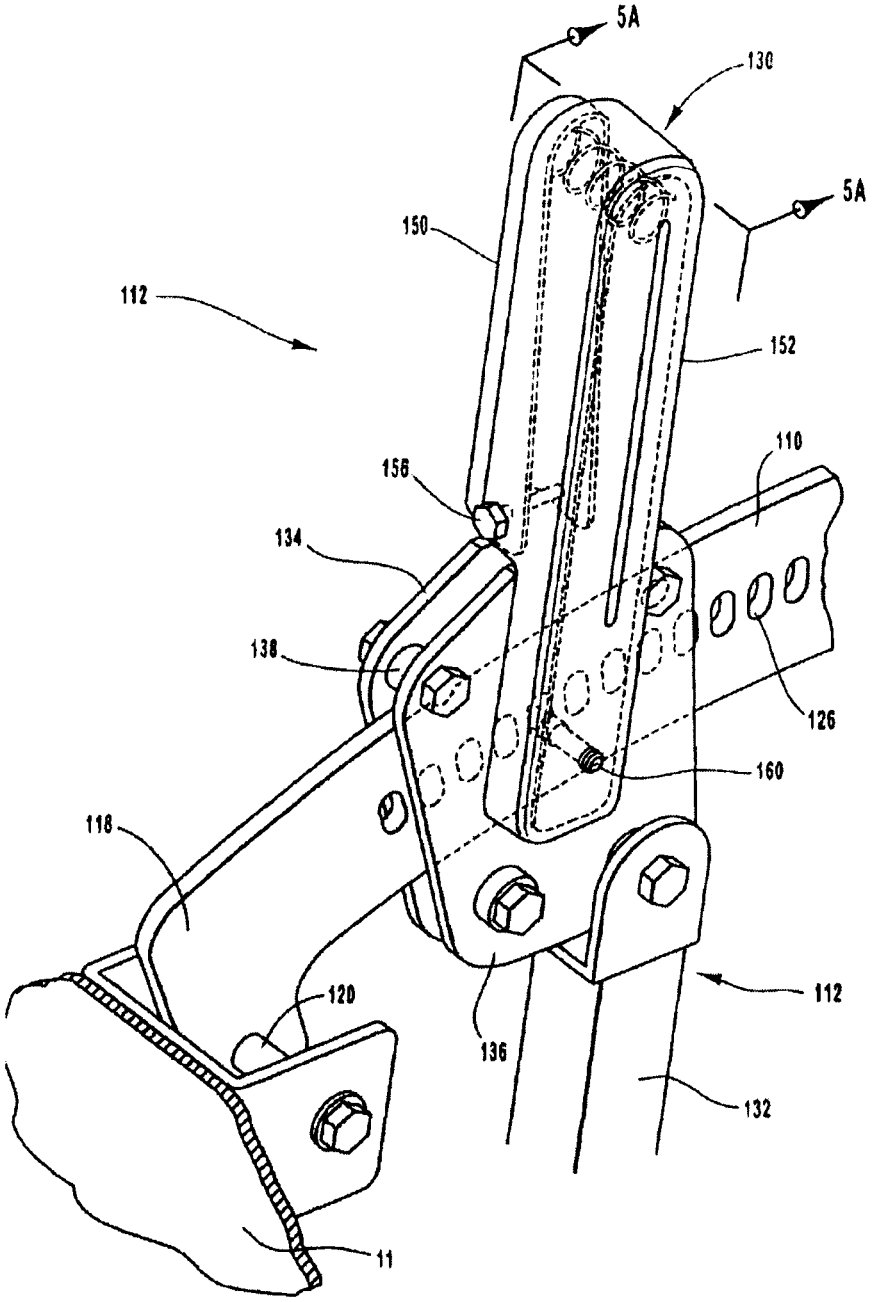

Referring now to FIGS. 11A and 11B, depicted is an alternate configuration of a resistance assembly according to another aspect of the present invention. The majority of features described with respect to resistance assembly 12 apply to resistance assembly 212. The resistance assembly 212 includes an arm 220 that cooperates with an actuating assembly 222. The arm 220 is pivotally mounted to a frame 240 of an exercise device, either directly or by way of an intermediary bracket 242, at a first end 224, and a second end 226 cooperates with a pulley assembly 228. The arm 220 is formed from two side by side plates separated one from another by an end plate. A first plate 232 and a portion of an end plate 236 are depicted in FIGS. 11A and 11B. It will be appreciated that in one embodiment the configuration the second plate is generally a mirror image of the first plate. Therefore, discussion with respect to first plate 232 is also applicable to the second plate.

The level or resistance provided by resistance assembly 212 may be selected through use if actuating assembly 222. The actuating assembly 222 cooperates with first plate 232 and the second plate that have complementary arced surfaces 250. The actuating assembly 222 moves along arced surfaces 250 to vary the level of resistance provided by resistance assembly 212. FIG. 11B depicts a situation where actuating assembly 222 has moved along arced surfaces 250.

The actuating assembly 222 includes a drive member 254 disposed between first plate 232 and the second plate (not shown). The drive member 254 extends from a second end 226 of arm 220 to threadably cooperate with a connecting assembly 260. Alternatively, drive member 254 may extend from end plate 236 toward connecting assembly 260. Whether drive member 254 is mounted to second end 226 of arm 220 or end plate 236 it cooperates with a motor 270 that may be pivotally mounted to arm 220. The motor 270 rotates drive member 254 to move a portion of connecting assembly 260 and vary the selected resistance of exercise device 210. The motor 270 may have various configurations, such as, but not limited to, an electrical motor or some other motor that is capable of rotating drive member 254.

Threadably cooperating with drive member 254 is connecting assembly 260 that extends from drive member 254 to resistance members 114*a*–114*n*. The connecting assembly 260 includes two connecting members, only connecting member 262*a* being depicted in FIGS. 11A and 11B, that extend from a cross member 264 to a support member 266 upon which resistance members 114*a*–114*n* are mounted. Alternatively, the connecting members may connect directly to one or more of resistance members 114*a*–114*n*.

The cross member 264 of connecting assembly 260 optionally pivots relative to the connecting members, only connecting member 262*a* being depicted in FIGS. 11A and 11B, while slidably cooperating with arced surfaces 250 of first plate 232 and the second plate (not shown) as cross member 264 engages with drive member 254. As cross member 264 moves along arced surfaces 250 the level of resistance that would be applied to an exercising user is varied. In another configuration, drive member 254 mates with a cross member that is located distant from arced surfaces 250, while a guide disposed at an end of the connecting members slides along arced surfaces 250 as the cross members moves along drive member 254.

In the illustrated configuration, cross member 264 includes a hole that is complementary to drive member 254, so that rotational movement of drive member 254 causes cross member 264 to move along the length of drive member 254. In one configuration, drive member 254 and cross member 264 include complementary threaded portions that engage to move cross member 264 along the length of drive member 254 as the same rotates. Other complementary configurations may be known to those skilled in the art in light of the teaching contained herein.

Optionally mounted to, or otherwise cooperating with, support member 266 are guides 272. Guides 272 slidable or rotatably engage with frame 240 to maintain resistance members 114*a*–114*n* in the desired position relative to frame 240 as they move under the influence of the connecting members. The guides 272 may have various configurations so long as they aid with positioning resistance members 114*a*–114*n*. For instance, a guide may have a stepped configuration where a portion of the guide is disposed between a resistance member and the frame, while another portion only cooperates with the frame. In another configuration, the guide is solely disposed between resistance member and the frame. In still another configuration, the guide solely cooperates with the frame.

The operation of resistance assembly 212 is similar to that described with respect to resistance assembly 12. A user may select a level of resistance by operating a controller (not shown) to cause motor 270 to rotate drive member 254. The controller may be an electronic controller that provides a digital readout of the resistance level chosen. Although one type of controller is identified, one skilled in the art may identify other controllers that may be used to perform the same function.

As drive member 254 rotates, cross member 264 moves along surfaces 250 of the plates. Once the desired level of resistance has been selected, such as a numerical value of the selected resistance being displayed upon a digital readout, engagement of cross member 264 and drive member 254 maintain actuating assembly 222 in the desired position. As a user operates the operable mechanisms of the exercise device, pulley assembly 228 moves toward pulley assembly 144, thereby moving the connecting members. The connecting members in turn moves second end 166 of resistance members 114*a*–114*n*, resulting in resistance members 114*a*–114*n* providing resistance to the motion of the exercising user.

The present invention, therefore provides various an exercise device that is capable of being readily adjustable to provide variable resistance to an exerciser using the exercise device. The adjustable resistance of the exercise device may be easily and efficiently modified through simply operating a handle mechanism or controller to change the resistance level of the exercise device. Additionally, by maintaining the actuating assembly generally between the pivoting arm and a second end of the resistance member the exercise device provides a resistance assembly that has compact characteristics, thereby limiting the overall space required or associated with the exercise device.

The resistance assemblies described herein may be used in conjuction with a variety of different exercise devices and the frame members, exercise mechanisms, and connecting systems described herein are only illustrative of the types of mechanisms that may be employed in conjunction with the resistance assemblies of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A resistance assembly configured to provide adjustable resistance to a motion of an exercise mechanism of an exercise device, the resistance assembly comprising:

(a) an arm having a first end pivotally coupled to a frame of the exercise device, the arm having a second end cooperating with the exercise mechanism such that movement of the exercise mechanism moves the arm;

(b) an actuating assembly moveably coupled to said arm; and (c) a resilient resistance member coupled to said actuating assembly such that (i) movement of the exercise mechanism of the exercise device results in the movement of the resilient resistance member and (ii) movement of the actuating assembly selectively adjusts the amount of resistance applied by the resistance assembly to movement of the exercise mechanism.

2. A resistance assembly as recited in claim 1, wherein said resistance member comprises a first end and a second end, said first end being coupled to a frame of the exercise device said second end being coupled to said actuating assembly.

3. A resistance assembly as recited in claim 1, wherein said actuating assembly comprises a motorized mechanism.

4. A resistance assembly as recited in claim 1, wherein said actuating assembly comprises a connecting member and a handle mechanism coupled to said connecting member, said handle mechanism being adapted to cooperate with said arm.

5. A resistance assembly as recited in claim 4, wherein said handle mechanism comprises a first member and a second member spring biased with respect to said first member.

6. A resistance assembly as recited in claim 5, wherein said second member further comprises an engagement member, said engagement member being adapted to selectively couple with at least one aperture within said arm.

7. A resistance assembly as recited in claim 1, wherein said actuating assembly is movably connected to said arm.

8. An assembly as recited in claim 1, wherein a cable and pulley system couples the arm to the exercise mechanism.

9. A resistance assembly configured to provide adjustable resistance to a motion of an exercise mechanism of an exercise device as a user moves the exercise mechanism, the resistance assembly comprising:

(a) an arm having a first end pivotally coupled to a frame of the exercise device, the arm having a second end cooperating with the exercise mechanism such that movement of the exercise mechanism moves the arm;

(b) a resiliently extendable resistance member having a first end and a second end, the first end being coupled to the frame; and (c) an actuating assembly having (i) a first end moveably coupled to the pivoting arm and (ii) a second end coupled to the second end of the resiliently extendable resistance member, such that movement of the actuating assembly selectively adjusts an amount of resistance applied by said resistance assembly to movement of the exercise mechanism.

10. A resistance assembly as recited in claim 9, wherein the first end of the resistance member is coupled to the frame at a position between the pivot axis of the arm and an end of the actuating assembly coupled to the second end of said resistance member.

11. A resistance assembly as recited in claim 9, wherein said resistance member comprises an elastomeric member.

12. An assembly as recited in claim 9 wherein a cable and pulley system couples the second end of the arm to the exercise mechanism.

13. An exercise device configured to provide adjustable resistance, the exercise device comprising:

a frame;

at least one exercise mechanism; and a resistance assembly configured to provide adjustable resistance to a motion of the exercise mechanism as a user moves the exercise mechanism;

a connecting system cooperating with the arm and the exercise mechanism such that movement of the exercise mechanism moves the arm;

wherein the resistance assembly comprises:

(a) an arm pivotally coupled to a frame of the exercise device;

(b) a resiliently extendable resistance member having a first end and a second end, the first end being coupled to the frame; and (c) an actuating assembly having (i) a first end moveably coupled to the pivoting arm and (ii) a second end coupled to the second end of the resiliently extendable resistance member, such that movement of the actuating assembly selectively adjusts an amount of resistance applied by said resistance assembly to movement of the exercise mechanism.

14. A device as recited in claim 13, wherein the connecting system comprises a cable and pulley system.

15. The exercise device as recited in claim 13, wherein said resistance member comprises at least one of an elastomeric member and a spring.

16. The exercise device as recited in claim 13, wherein said actuating assembly comprises a connecting member coupled to a handle mechanism, at least a portion of said handle mechanism being pivotally coupled to said connecting member.

17. The exercise device as recited in claim 16, wherein said handle mechanism comprises a spring-loaded handle configured to selectively couple to said arm.

18. The exercise device as recited in claim 17, wherein said handle mechanism comprises a first member and a moveable member spring biased with respect to said first member.

19. The exercise device as recited in claim 18, wherein said handle mechanism comprises at least one engagement member, said at least one engagement member being adapted to selectively couple to said arm as said spring-loaded handle manipulated.

20. The exercise device as recited in claim 13, wherein said exercise device further comprises a track coupled to said frame, said track being adapted to receive at least a portion of said resistance member and wherein at least a portion of said resistance member slidably engages with said track.

21. The exercise device as recited in claim 13, wherein said actuating assembly comprises at least one wheel adapted to cooperate with a portion of said arm and aid in moving said actuating assembly along said arm.

22. The exercise device as recited in claim 13, wherein movement of said arm results in movement of said second end of said resistance member.

* * * * *

UNITED STATES PATENT AND TRADEMARK OFFICE

CERTIFICATE OF CORRECTION

PATENT NO. : 6,685,607 B1
DATED : February 3, 2004
INVENTOR(S) : Michael L. Olson It is certified that error appears in the above-identified patent and that said Letters Patent is hereby corrected as shown below:

Column 4,
Line 28, change “furthers” to -- further --
Line 50, change “loosing” to -- losing --
Line 58, change “as over head” to -- as overhead --

Column 5,
Line 52, change “mechanism 16 is shown” to -- mechanism 16 shown --
Line 65, change “extension member” to -- an extension member. --

Column 6,
Line 3, change “user” to -- users --
Line 34, change “arm: 110” to -- arm 110 --
Line 49, change “associated the one” to -- associated with the one --

Column 7,
Line 30, change “with” to -- will --
Line 44, change “one or another.” to -- from one another. --
Line 63, change “having” to -- have --
Line 64, change “of member” to -- of a member --

Column 9,
Line 18, change “may having any” to -- may have any --
Line 29, change “levels occurs” to -- levels occur --
Line 49, change “affect” to -- effect --
Lines 55-56, change “of available” to -- of the available --

Column 10,
Line 3, change “that is.” to -- that is --
Line 6, change “maintain resistance.” to -- maintain resistance --
Line 37, change “point attachment” to -- point of attachment --

Column 11,
Line 12, change “configuration the” to -- configuration of the --
Line 17, change “if” to -- of --
Line 31, change “plate 236” to -- plate 236, --
Line 54, change “surfaces 250” to -- surfaces 250, --

UNITED STATES PATENT AND TRADEMARK OFFICE

CERTIFICATE OF CORRECTION

PATENT NO. : 6,685,607 B1
DATED : February 3, 2004
INVENTOR(S) : Michael L. Olson It is certified that error appears in the above-identified patent and that said Letters Patent is hereby corrected as shown below:

Column 12,
Line 5, change “slidable” to -- slidably --
Lines 15-16, change “between resistance member” to -- between the resistance member --
Line 37, change “moves” to -- move --
Line 41, change “provides various an exercise” to -- provides an exercise --
Line 49, change “resistance member” to -- resistance member, --

Column 14,
Line 50, change “handle manipulated” to -- handle is manipulated --

Signed and Sealed this

Twenty-eighth Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,685,607 B1
APPLICATION NO. : 10/340562
DATED : February 3, 2004
INVENTOR(S) : Michael L. Olson It is certified that error appears in the above-identified patent and that said Letters Patent is hereby corrected as shown below:

Drawings
Sheet 5, replace FIG. 4 with the figure depicted on the following page, wherein fixed member 158 is relabeled 150 and label 116, which is never mentioned, is removed Column 4
Line 37, change "illustrates" to --illustrate--
Line 62, add --,-- after "16"

Column 5
Line 65, change "extension member" to --extension member 96.--

Column 7
Line 32, change "(FIG. 3A)" to --(FIG. 3)--

Column 8
Line 6, change "spring 152" to --spring 154--
Line 29, change "aperture 160" to --aperture 126--

Column 9
Line 27, change "members" to --member--
Line 31, change "members" to --member--
Line 41, change "hence the amount" to --hence a different--

Signed and Sealed this

Twenty-second Day of June, 2010

David J. Kappos

David J. Kappos
*Director of the United States Patent and Trademark Office*